United States Patent [19]

Bertoldi

[11] Patent Number: 4,468,937

[45] Date of Patent: Sep. 4, 1984

[54] MACHINE FOR THE FULLING AND WASHING OF CORD FABRICS

[76] Inventor: Attilio Bertoldi, Via Luzzago 27, 25025 Manerbio (Brescia), Italy

[21] Appl. No.: 340,916

[22] Filed: Jan. 20, 1982

[30] Foreign Application Priority Data

Jan. 23, 1981 [IT] Italy ..... 19288 A/81

[51] Int. Cl.[3] ..... D06B 3/26; D06B 15/02; D06B 15/09

[52] U.S. Cl. ..... 68/19.1; 15/306 A; 26/21; 34/155; 34/160; 68/20; 68/22 R; 68/177

[58] Field of Search ..... 68/5 C, 5 D, 19.1, 20, 68/22 R, 62, 177, 178, 200, 176; 34/155, 156, 160; 26/20, 21; 28/265; 15/306 A; 226/97

[56] References Cited

U.S. PATENT DOCUMENTS

| | | | |
|---|---|---|---|
| 3,567,093 | 3/1971 | Johnson | 226/97 |
| 3,780,544 | 12/1973 | Turner et al. | 68/177 |
| 3,921,420 | 11/1975 | Aurich et al. | 68/5 C |
| 3,959,843 | 6/1976 | Yokota et al. | 15/306 A |
| 4,089,193 | 5/1978 | Mitter | 68/5 D |
| 4,270,978 | 6/1981 | Fioravanti | 15/306 A X |
| 4,318,209 | 3/1982 | Schuierer | 68/177 X |

FOREIGN PATENT DOCUMENTS

| | | | |
|---|---|---|---|
| 937465 | 1/1956 | Fed. Rep. of Germany . | |
| 1785141 | 12/1972 | Fed. Rep. of Germany | 68/177 |
| 2359276 | 6/1975 | Fed. Rep. of Germany | 68/200 |
| 376499 | 6/1973 | U.S.S.R. | 26/21 |

*Primary Examiner*—Philip R. Coe

[57] ABSTRACT

Internally of its tub, the machine provides a conduit fitted with fan-shaped delivery outlet. The fan portion of said delivery outlet terminates with an arcuate surface provided with slots along which the fabric being processed runs. The conduit has connected thereto a water supply pipe for the conveyance of air mixed with water on the fabric being processed.

1 Claim, 1 Drawing Figure

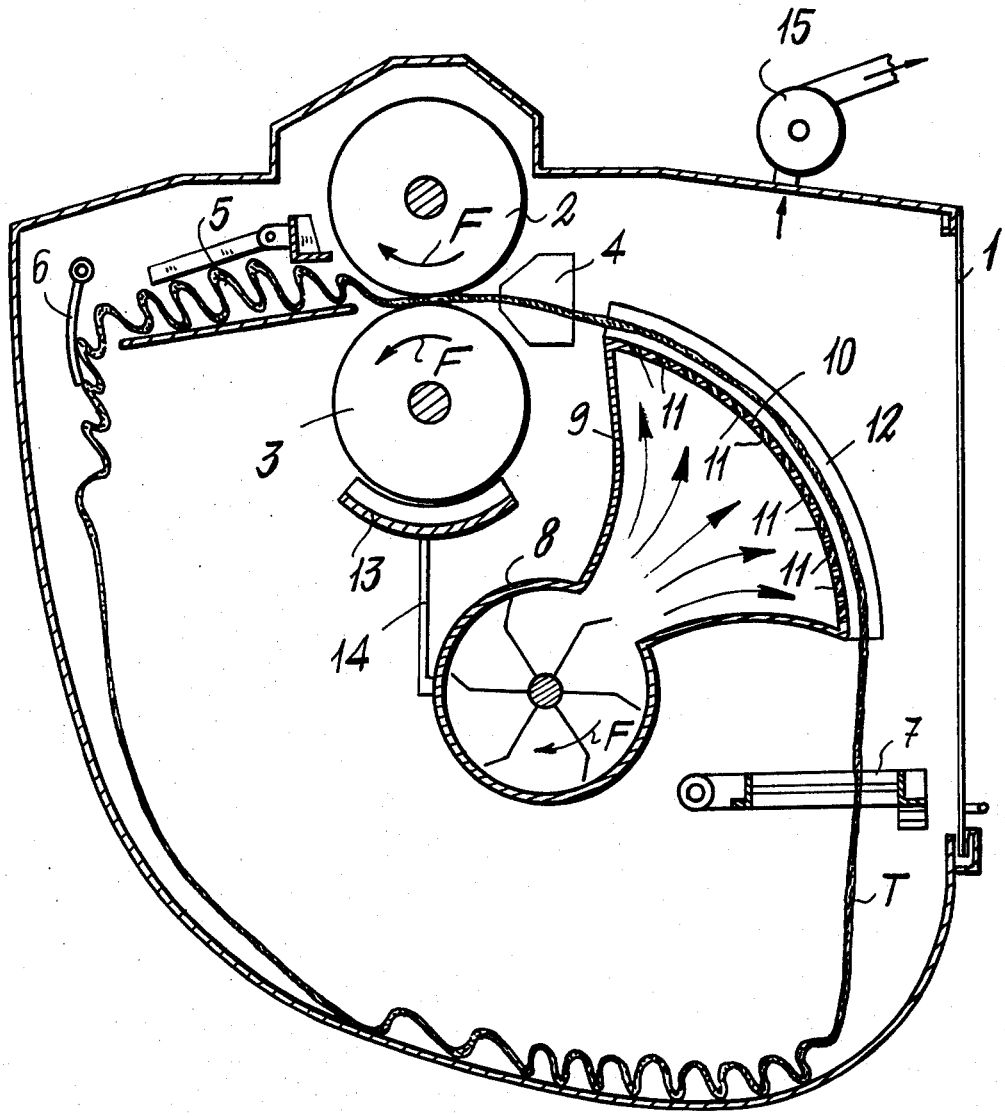
15
5
2
F
4
1
6
F
10
9
11
12
3
11
11
8
11
13
14
F
7
T

MACHINE FOR THE FULLING AND WASHING OF CORD FABRICS

The present patent for industrial invention is concerned with a machine for the fulling and washing of cord fabrics.

As well known, the conventional fullers are formed to allow only the fulling and washing of cord fabrics previously sewn in tubular shape, and the so processed fabrics are then predried and thereafter finally dried for subsequent transfer to further processings.

It is the object of the present invention to provide a machine allowing the fulling and washing of fabrics, without any need of sewing the latter in tubular shape and enabling the washing of such fabrics in a shorter time and less consumption of water.

This and other objects of the invention will become apparent to those skilled in the art from the reading of the following description and claims.

According to the invention, a machine is essentially characterized in that internally of the tub a conduit is disposed for the conveyance of air mixed with water towards the fabric being processed, said conduit being provided with a fan-shaped delivery outlet terminating with an arcuate surface, or two angled segments, provided with slots for the run therealong of the fabric being processed, said fan portion being disposed upstream, in connection with the direction of forward movement of the fabric, of conventional rollers and associated fulling and washing devices.

A preferred embodiment of the invention is schematically shown in a sectional view, by mere way of unrestrictive example, on the single FIGURE of the accompanying drawing.

Referring to said FIGURE of the accompanying drawing, reference numeral 1 designates a tub conventionally provided with a pair of upper and lower fulling rollers 2 and 3, respectively, anyhow driven for rotation in the direction of arrows F, jaws 4 for fulling in height, a fulling well 5 and a beating spatula 6. During repeated passes, the fabric T is guided in its travel by a creel 7.

According to the invention, the tub 1 has disposed therein a fan 8, suitably rotably driven in the direction of arrow F' by a motor, not shown, provided with an air intake outside of the tub 1, and a delivery outlet opening into a conveyor 9.

Said conveyor has a fan-like development and its arcuate surface 10 is provided with slots 11 and side walls 12 for containing said fabric T. As shown in the drawing, the surface 10 terminates in the vicinity of the jaws 4, thus serving as a guide for starting said fabric towards said jaws.

From a collection basin 13, conventionally provided at the bottom of roller 3, a tube 14 is branched off for the conveyance of the water wrung by the rollers 2 and 3 within the casing of the fan 8. The machine is completed by an aspirator 15 disposed at the top of tub 1.

The proposed solution enables a wet processing of fabrics without the latter having to be sewn in tubular shape, as the air blows by the fan 8 causes the desired swelling of the fabrics as required for (a) preventing the fabrics from length wise rolling up, and (b) causing the fabric to swell, by filling up with air, to pneumatically stretch out the folds or creases formed during the process.

The washing water from the fabric wringling through the action of the rollers 2 and 3 is mixed with air and forced to exit under pressure out of the slots 11, thus acting on the fabric T along a very wide surface with a resulting considerable reduction in washing time and saving of water.

In the embodiment shown, an arcuate surface 10 is contemplated as provided with only two side guide walls 12, but evidently such a surface could be divided by a larger number of walls 12 to form as many guide channels as the strips of fabric being simultaneously processed.

What I claim is:

1. A machine for washing fabrics in the form of a rope having ends which are attached to each other to form a fabric ring, the machine comprising:

(a) a tub;

at least a pair of rollers urged one against the other and disposed in the tub, the rollers defining means therebetween for the passage of the fabric ring, at least one of the rollers being actuated to cause rotation of the fabric ring in the tub at a speed sufficient to create a centrifugal force on the fabric ring;

(c) a constrictive passage means for receiving the fabric ring fed by the pair of rollers;

(d) a perforated surface in the tub located inside the circle defined by the fabric ring, the inner surface of the fabric ring being adapted to pass over the perforated surface; and (e) means for blowing air through the perforated surface towards the inner surface of the fabric ring for swelling the fabric passing over the perforated surface and pneumatically stretching out folds or creases formed on the fabric.

* * * * *